US010720740B1

(12) United States Patent
Lu

(10) Patent No.: US 10,720,740 B1
(45) Date of Patent: Jul. 21, 2020

(54) PLUG, POWER SUPPLY AND POWER CONNECTOR

(71) Applicant: CHICONY POWER TECHNOLOGY CO., LTD., New Taipei (TW)

(72) Inventor: Jung-Chang Lu, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/551,486

(22) Filed: Aug. 26, 2019

(30) Foreign Application Priority Data

May 8, 2019 (TW) ..... 108115957 A

(51) Int. Cl.
*H01R 13/64* (2006.01)
*H01R 29/00* (2006.01)
*H01R 27/00* (2006.01)

(52) U.S. Cl.
CPC ..... *H01R 29/00* (2013.01); *H01R 27/00* (2013.01)

(58) Field of Classification Search
CPC .. H01R 23/7068; H01R 23/688; H01R 13/64; H01R 23/7073; H01R 103/00; H01R 13/652
USPC ..... 439/924.1, 101, 680, 660, 568, 106
See application file for complete search history.

(56) References Cited

U.S. PATENT DOCUMENTS 7,642,671 B2 1/2010 Mahaffey
8,070,878 B2 * 12/2011 Dubey ..... E04C 2/049 106/713
8,212,386 B2 7/2012 Mahaffey
8,333,616 B2 * 12/2012 Su ..... H01R 13/6581 439/607.41
8,951,075 B2 * 2/2015 Ekchian ..... H01R 13/4538 439/170
9,484,756 B2 11/2016 Su et al.
10,027,072 B1 * 7/2018 Shaeffer ..... H01R 24/28
10,446,961 B1 * 10/2019 Chang ..... H01R 13/52
2004/0198442 A1 10/2004 Chan et al.
2005/0048846 A1 * 3/2005 Suzuki ..... H01R 24/60 439/660

(Continued)

FOREIGN PATENT DOCUMENTS

TW 583863 B 4/2004
TW I436572 B 6/2008
TW M372040 U1 1/2010

(Continued)

*Primary Examiner* — Phuong Chi Thi Nguyen
(74) *Attorney, Agent, or Firm* — Muncy, Geissler, Olds & Lowe, P.C.

(57) ABSTRACT

A plug includes a first member and a second member detachably connected to each other. The first member includes four conductors, which are separated from each other. The third and fourth conductors are selectively electrically connected to the first and second conductors, respectively. The second member includes four pins. The first and second pins are electrically connected to the first and second conductors, respectively, and are selectively electrically connected to the third and fourth conductors, respectively. The third and fourth pins are electrically connected to the first and second pins, respectively. The first and second pins are separated from each other, and the third and fourth pins are separated from each other. A power supply configured with the plug and a power connector are also provided.

11 Claims, 7 Drawing Sheets

(56) References Cited

U.S. PATENT DOCUMENTS

| | | | |
|---|---|---|---|
| 2010/0231185 | A1 | 9/2010 | Yu et al. |
| 2012/0139511 | A1 | 6/2012 | Chou et al. |

FOREIGN PATENT DOCUMENTS

| | | | |
|---|---|---|---|
| TW | M382660 | U1 | 6/2010 |
| TW | M385163 | U1 | 7/2010 |
| TW | 201143226 | A1 | 12/2011 |

* cited by examiner

PLUG, POWER SUPPLY AND POWER CONNECTOR

CROSS REFERENCE TO RELATED APPLICATIONS

This Non-provisional application claims priority under 35 U.S.C. § 119(a) on Patent Application No(s). 108115957 filed in Taiwan, Republic of China on May 8, 2019, the entire contents of which are hereby incorporated by reference.

BACKGROUND

Technology Field

The present disclosure relates to a plug, a power supply and a power connector. In particular, this disclosure relates to a plug, a power supply and a power connector that can adjust the voltage.

Description of Related Art

Generally, the conventional power plugs and power supplies are the devices that deliver or output a constant voltage. When used in different states or with different electronic devices, different power plugs and power supplies are frequently required to obtain the most compatible voltage. However, according to the aforementioned situation, the user needs to carry different plugs or power supplies for different electronic devices, resulting in inconvenience and unnecessary waste of resources.

A variable-voltage power supply, which is configured with different resistors in the power supply and cooperated with the manual switch, has been provided for outputting different voltages by adjusting the manual switch to connect different resistors. However, the relatively complicated circuits and circuit traces of the conventional variable-voltage power supply need to be designed, resulting in the increased manufacturing cost. In addition, the design of the manual switch is likely to get stuck after the user pulls the manual switch many times. Besides, an unwanted change of voltage may occur due to the unintentional operation by the user, which may cause an abnormal output voltage, and may likely cause damage to the electronic device thus jeopardizes the reliability of the power supply.

Therefore, it is desired to provide a plug and a power supply with the functions of voltage change yet without the design burdens of additional complicated circuits and circuit traces, thereby decreasing the manufacturing cost and increasing the reliability of the plug and the power supply.

SUMMARY

An objective of this disclosure is to provide a plug, a power supply and a power connector. Compared with the conventional art, this disclosure can change the output voltage by changing the state of the plug, so that the complicated circuits or circuit traces conventionally designed for the plug, the power supply and the power connector are not needed, thereby decreasing the manufacturing cost and increasing the reliability of the plug, the power supply and the power connector.

To achieve the above objective, the present disclosure provides a plug, which comprises a first member and a second member. The first member comprises a first conductor, a second conductor, a third conductor and a fourth conductor. The first conductor and the second conductor are configured for power receiving. The third conductor is selectively electrically connected to the first conductor, and the fourth conductor is selectively electrically connected to the second conductor. The first conductor, the second conductor, the third conductor and the fourth conductor are separated from each other. The second member is detachably connected to the first member and comprises a first pin, a second pin, a third pin and a fourth pin. The first pin is electrically connected to the first conductor and selectively electrically connected to the third conductor. The second pin is electrically connected to the second conductor and selectively electrically connected to the fourth conductor. The third pin is electrically connected to the first pin for power outputting. The fourth pin is electrically connected to the second pin for power outputting. The first pin and the second pin are separated from each other, and the third pin and the fourth pin are separated from each other. When the second member is connected to the first member, the plug is in a first state, a second state, a third state or a fourth state. In the first state, the first pin is electrically connected to the first conductor and the third conductor, and the second pin is electrically connected to the second conductor and the fourth conductor. In the second state, the first pin is electrically connected to the first conductor and the third conductor, and the second pin is only electrically connected to the second conductor. In the third state, the first pin is only electrically connected to the first conductor, and the second pin is electrically connected to the second conductor and the fourth conductor. In the fourth state, the first pin is only electrically connected to the first conductor, and the second pin is only electrically connected to the second conductor.

In one embodiment, the first member further comprises a first housing, and the first conductor, the second conductor, the third conductor and the fourth conductor are disposed inside the first housing. The first housing is defined with a first direction and a second direction different from the first direction. The first conductor and the third conductor are arranged along the first direction, the second conductor and the fourth conductor are arranged along the first direction, and the first conductor and the second conductor are juxtaposed in the second direction.

In one embodiment, the second member further comprises a second housing corresponding to the first housing, the first pin and the second pin are disposed on one side of the second housing, and the third pin and the fourth pin are disposed on another side the second housing. The second housing is defined with a third direction and a fourth direction different from the third direction, the first pin and the second pin extend outwardly from the second housing along the third direction, and the first pin and the second pin are juxtaposed in the fourth direction.

In one embodiment, the first pin and the second pin are two conductive columns. The first conductor, the second conductor, the third conductor and the fourth conductor are four conductive contacts for being contacted by the conductive columns. In the first state, the first pin contacts the first conductor and the third conductor, and the second pin contacts the second conductor and the fourth conductor. In the second state, the first pin contacts the first conductor and the third conductor, and the second pin only contacts the second conductor. In the third state, the first pin only contacts the first conductor, and the second pin contacts the second conductor and the fourth conductor. In the fourth state, the first pin only contacts the first conductor, and the second pin only contacts the second conductor.

In one embodiment, the plug further comprises a cable connecting to the first member. The cable comprises a first conductive wire, a second conductive wire, a third conductive wire, and a fourth conductive wire. The first conductive wire is electrically connected to the first conductor for power transmitting. The second conductive wire is electrically connected to the second conductor for power transmitting. The third conductive wire is electrically connected to the third conductor. The fourth conductive wire is electrically connected to the fourth wire.

To achieve the above objective, the present disclosure also provides a power supply disposed between a power source and an electronic device. The power supply comprises a power conversion unit, a control unit, and a plug. The power conversion unit is configured for receiving and converting an electric power provided from the power source. The control unit is electrically connected to the power conversion unit. The plug is electrically connected to the power conversion unit, the control unit and the electronic device. The plug comprises a first member and a second member. The first member comprises a first conductor, a second conductor, a third conductor and a fourth conductor. The first conductor and the second conductor are electrically connected to the power conversion unit, and the third conductor and the fourth conductor are electrically connected to the control unit. The second member is detachably connected to the first member and comprises a first pin, a second pin, a third pin and a fourth pin. The first pin is electrically connected to the first conductor and selectively electrically connected to the third conductor. The second pin is electrically connected to the second conductor and selectively electrically connected to the fourth conductor. The third pin is electrically connected to the first pin and the electronic device. The fourth pin is electrically connected to the second pin and the electronic device. When the second member is connected to the first member, the plug is in a first state, a second state, a third state or a fourth state. In the first state, the first pin is electrically connected to the first conductor and the third conductor, and the second pin is electrically connected to the second conductor and the fourth conductor. In the second state, the first pin is electrically connected to the first conductor and the third conductor, and the second pin is only electrically connected to the second conductor. In the third state, the first pin is only electrically connected to the first conductor, and the second pin is electrically connected to the second conductor and the fourth conductor. In the fourth state, the first pin is only electrically connected to the first conductor, and the second pin is only electrically connected to the second conductor.

In one embodiment, the control unit controls the power conversion unit according to a state of the plug. If the plug is in the first state, the power conversion unit provides a first voltage to the electronic device through the plug. If the plug is in the second state, the power conversion unit provides a second voltage to the electronic device through the plug. If the plug is in the third state, the power conversion unit provides a third voltage to the electronic device through the plug. If the plug is in the fourth state, the power conversion unit provides a fourth voltage to the electronic device through the plug.

In one embodiment, the first member further comprises a first housing, and the second member further comprises a second housing corresponding to the first housing. The first conductor, the second conductor, the third conductor and the fourth conductor are disposed inside the first housing. The first pin and the second pin are disposed on one side of the second housing, and the third pin and the fourth pin are disposed on another side the second housing. The first housing is defined with a first direction and a second direction different from the first direction, and the second housing is defined with a third direction and a fourth direction different from the third direction. The first conductor and the third conductor are arranged along the first direction, the second conductor and the fourth conductor are arranged along the first direction, and the first conductor and the second conductor are juxtaposed in the second direction. The first pin and the second pin extend outwardly from the second housing along the third direction, and the first pin and the second pin are juxtaposed in the fourth direction.

In one embodiment, the first pin and the second pin are two conductive columns, and the first conductor, the second conductor, the third conductor and the fourth conductor are four conductive contacts for being contacted by the conductive columns. In the first state, the first pin contacts the first conductor and the third conductor, and the second pin contacts the second conductor and the fourth conductor. In the second state, the first pin contacts the first conductor and the third conductor, and the second pin only contacts the second conductor. In the third state, the first pin only contacts the first conductor, and the second pin contacts the second conductor and the fourth conductor. In the fourth state, the first pin only contacts the first conductor, and the second pin only contacts the second conductor.

In one embodiment, the power supply further comprises a feedback circuit unit electrically connected between the control unit and the power conversion unit. The feedback circuit unit adjusts an operation of the power conversion unit according to a signal outputted from the control unit.

In one embodiment, the power supply further comprises an output circuit unit electrically connected between the power conversion unit and the plug. The output circuit unit is configured to stabilize a voltage and a current outputted from the power conversion unit.

To achieve the above objective, the disclosure further provides a power connector comprising a first connecting member and a second connecting member detachably connected with the first connecting member. The first connecting member is electrically connected to a power adapter, and the second connecting member is electrically connected to an electronic device. The first connecting member comprises a first conductive set and a second conductive set. The first conductive set comprises a first conductor and a third conductor, and the second conductive set comprises a second conductor and a fourth conductor. The second connecting member comprises a first terminal and a second terminal.

In one embodiment, when the first connecting member is connected to the second connecting member, the power connector is in a first connecting mode, a second connecting mode, a third connecting mode or a fourth connecting mode.

In one embodiment, when the power connector is in the first connecting mode, the first terminal is connected to the first conductor and the third conductor, and the second terminal is connected to the second conductor and the fourth conductor.

In one embodiment, when the power connector is in the second connecting mode, the first terminal is connected to the first conductor and the third conductor, and the second terminal is connected to the second conductor.

In one embodiment, when the power connector is in the third connecting mode, the first terminal is connected to the first conductor, and the second terminal is connected to the second conductor and the fourth conductor.

In one embodiment, when the power connector is in the fourth connecting mode, the first terminal is connected to the first conductor, and the second terminal is connected to the second conductor.

In one embodiment, the first conductor and the second conductor are individually electrically connected to a power conversion unit of the power adapter, and the third conductor and the fourth conductor are individually electrically connected to a control unit of the power adapter.

In one embodiment, when the power connector is in the first connecting mode, the power adapter transmits a first voltage to the electronic device. When the power connector is in the second connecting mode, the power adapter transmits a second voltage to the electronic device. When the power connector is in the third connecting mode, the power adapter transmits a third voltage to the electronic device. When the power connector is in the fourth connecting mode, the power adapter transmits a fourth voltage to the electronic device.

As mentioned above, this disclosure can change the output voltage by changing the state of the plug, so that the complicated circuits or circuit traces conventionally designed for the plug, the power supply and the power connector are not needed, thereby decreasing the manufacturing cost and increasing the reliability of the plug, the power supply and the power connector.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

The plug, the power supply and the power connector of this disclosure can change the output voltage by changing the state of the plug, so that the complicated circuits or circuit traces conventionally designed for the plug, the power supply and the power connector to achieve the function of voltage change are not needed, thereby decreasing the manufacturing cost and increasing the reliability of the plug, the power supply and the power connector.

Figure 1:
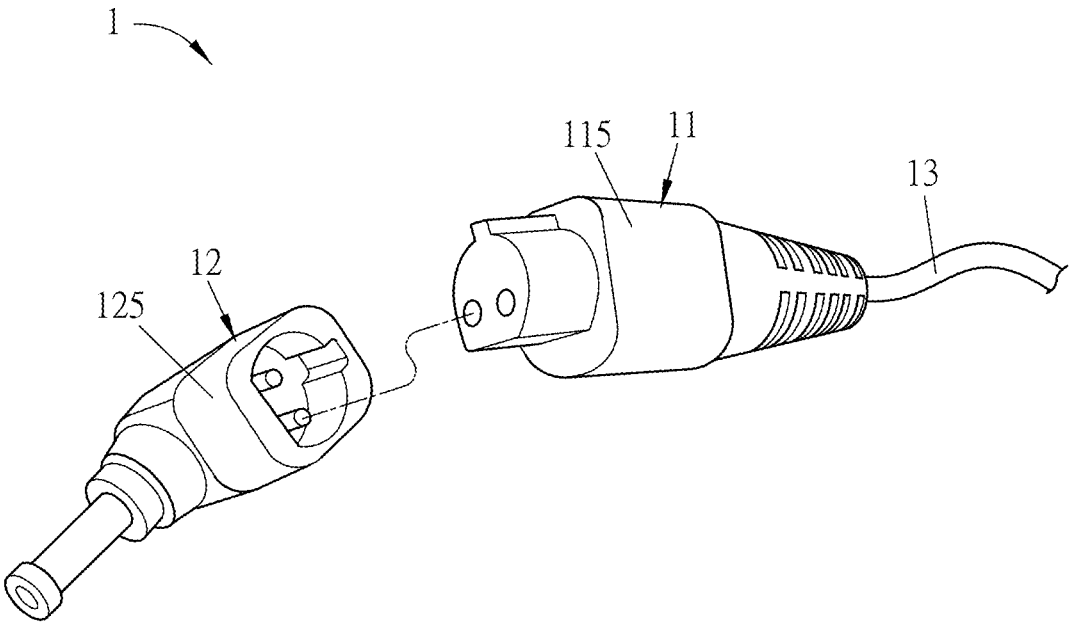
FIG. 1 is a schematic diagram showing a plug according to an embodiment of this disclosure.
Figure 2A:
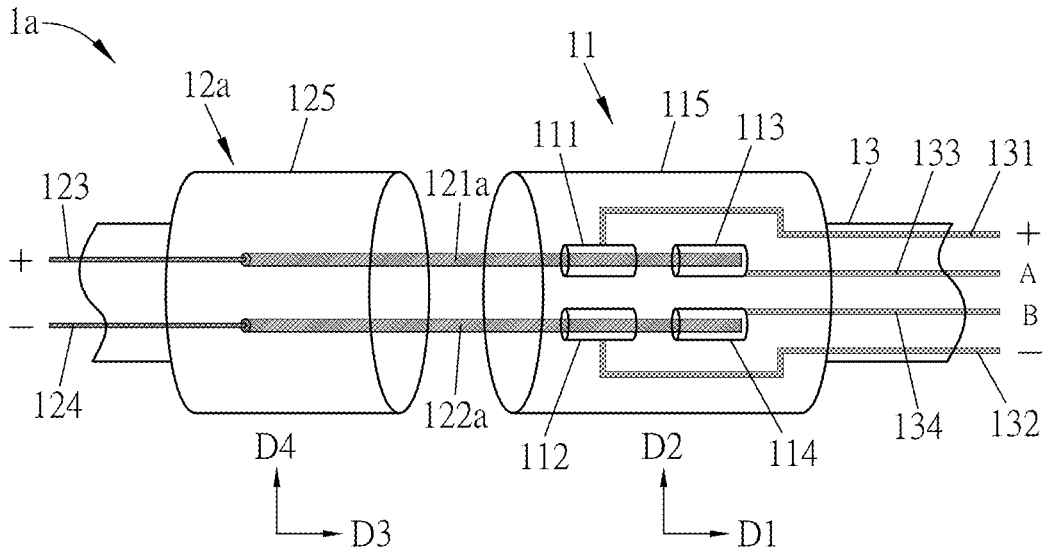
FIG. 2A is a schematic diagram showing the internal configuration of a plug according to a first embodiment of this disclosure, wherein the plug is in a first state.

FIG. 1 is a schematic diagram showing a plug according to an embodiment of this disclosure, and FIG. 2A is a schematic diagram showing the internal configuration of a plug according to a first embodiment of this disclosure, wherein the plug is in a first state. Referring to FIG. 1, the plug 1 of this embodiment comprises a first member 11 and a second member 12. The second member 12 is detachably connected to the first member 11. As shown in FIG. 2A, the first member 11 comprises a first conductor 111, a second conductor 112, a third conductor 113, and a fourth conductor 114. The first conductor 111 and the second conductor 112 are configured for power receiving. The third conductor 113 is selectively electrically connected to the first conductor 111, and the fourth conductor 114 is selectively electrically connected to the second conductor 112. The first conductor 111, the second conductor 112, the third conductor 113, and the fourth conductor 114 are separated from each other.

Referring to FIGS. 1 and 2A, in this embodiment, the second member 12*a* comprises a first pin 121*a*, a second pin 122*a*, a third pin 123, and a fourth pin 124. The first pin 121*a* is electrically connected to the first conductor 111 and selectively electrically connected to the third conductor 113. The second pin 122*a* is electrically connected to the second conductor 112 and selectively electrically connected to the fourth conductor 114. The third pin 123 is electrically connected to the first pin 121*a* for power outputting. The fourth pin 124 is electrically connected to the second pin 122*a* for power outputting. The first pin 121*a* and the second pin 122*a* are separated from each other, and the third pin 123 and the fourth pin 124 are separated from each other.

Figure 2B:
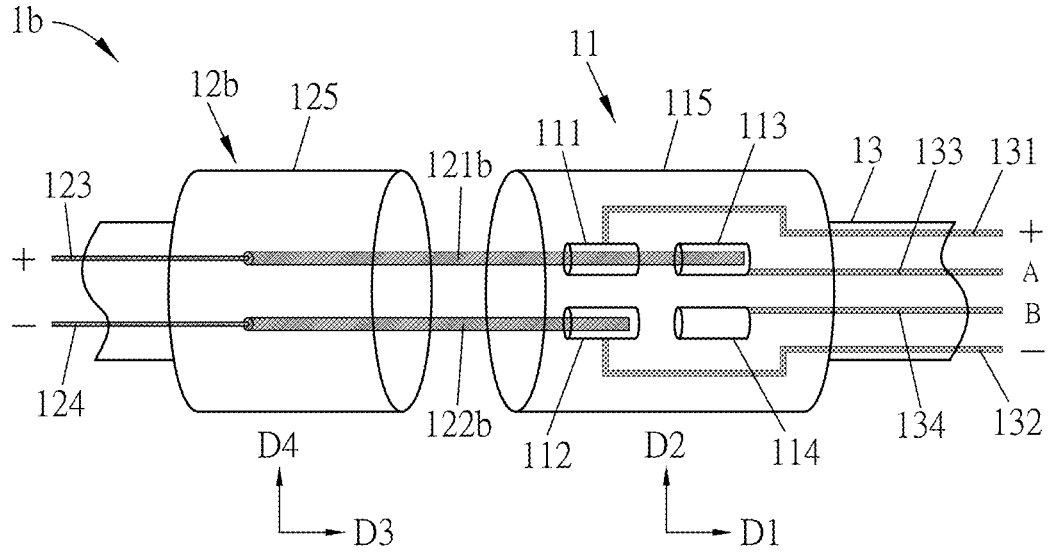
FIG. 2B is a schematic diagram showing the internal configuration of the plug according to the first embodiment of this disclosure, wherein the plug is in a second state.
Figure 2C:
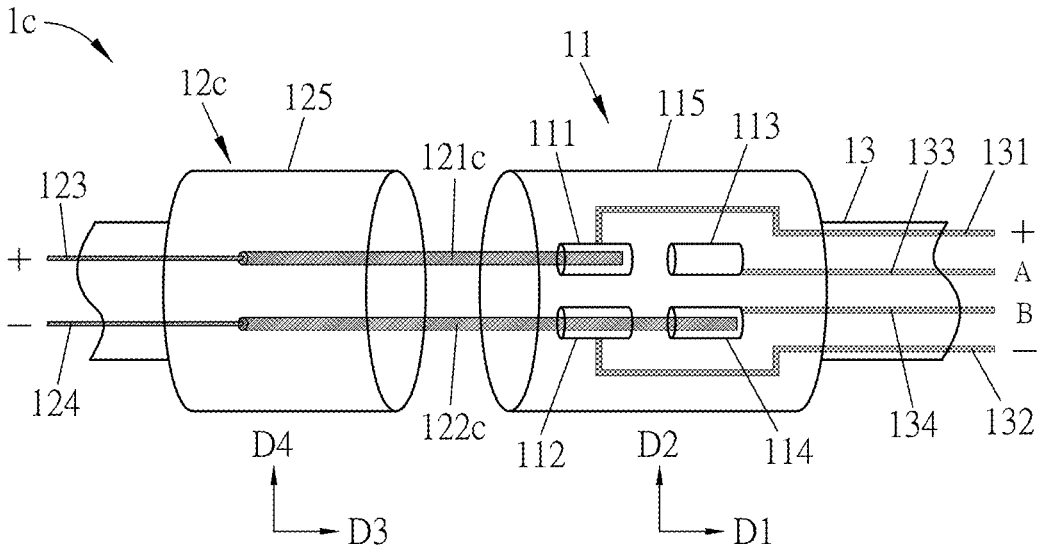
FIG. 2C is a schematic diagram showing the internal configuration of the plug according to the first embodiment of this disclosure, wherein the plug is in a third state.
Figure 2D:
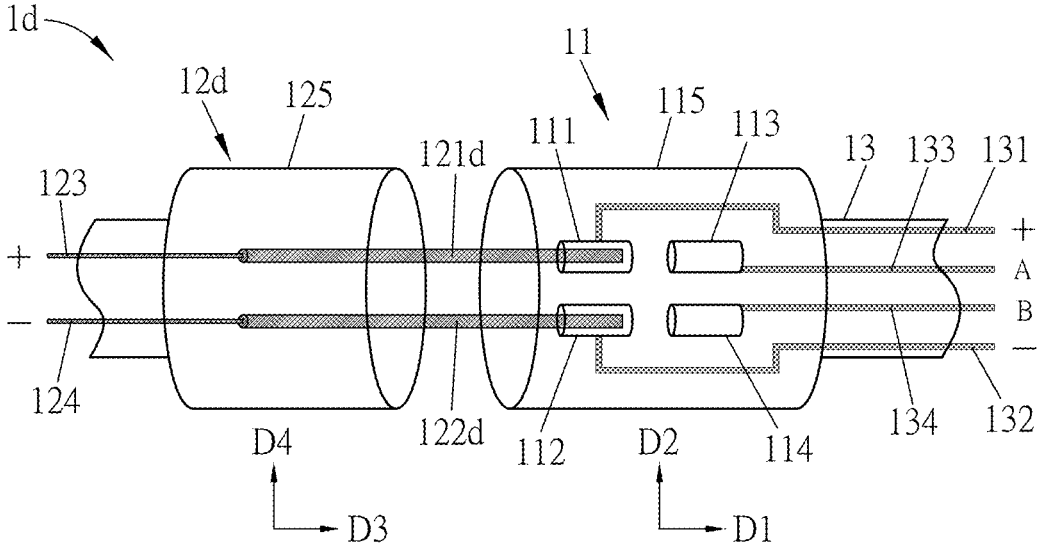
FIG. 2D is a schematic diagram showing the internal configuration of the plug according to the first embodiment of this disclosure, wherein the plug is in a fourth state.

FIG. 2B is a schematic diagram showing the internal configuration of the plug according to the first embodiment of this disclosure, wherein the plug is in a second state. FIG. 2C is a schematic diagram showing the internal configuration of the plug according to the first embodiment of this disclosure, wherein the plug is in a third state. FIG. 2D is a schematic diagram showing the internal configuration of the plug according to the first embodiment of this disclosure, wherein the plug is in a fourth state. Referring to FIGS. 2A to 2D and the following Table I, when the second members 12*a*, 12*b*, 12*c* and 12*d* are individually connected to the first members 11, the plugs 1*a*, 1*b*, 1*c* and 1*d* are in a first state, a second state, a third state and a fourth state, respectively. As shown in FIG. 2A, the plug 1*a* is in the first state, in which the first pin 121*a* is electrically connected to the first conductor 111 and the third conductor 113, and the second pin 122*a* is electrically connected to the second conductor 112 and the fourth conductor 114. As shown in FIG. 2B, the plug 1*b* is in the second state, in which the first pin 121*b* is electrically connected to the first conductor 111 and the third conductor 113, and the second pin 122*b* is only electrically connected to the second conductor 112. As shown in FIG. 2C, the plug 1*c* is in the third state, in which the first pin 121*c* is only electrically connected to the first conductor 111, and the second pin 122*c* is electrically connected to the second conductor 112 and the fourth conductor 114. As shown in FIG. 2D, the plug 1*d* is in the fourth state, in which the first pin 121*d* is only electrically connected to the first conductor 111, and the second pin 122*d* is only electrically connected to the second conductor 112. As shown in FIGS. 2A to 2D, the plugs 1*a*, 1*b*, 1*c* and 1*d* are in four different states by correspondingly changing four different second members 12*a*, 12*b*, 12*c* and 12*d*. To be noted, as shown in FIG. 1, the plug 1 may have only one second member 12, and the plug 1 can have four different states by replacing different first pins 121*a*, 121*c* and different second pins 122*a*, 122*b*. On the other hand, the plug 1 may have only three second members 12*a*, 12*b*, 12*d*, and the plug 1 can have four different states by changing the connected position of the second member 12*b*. The detailed description will be discussed in the following.

TABLE I

States of plug and electrical condition of each state.

| State of plug | Is the first pin electrically connected to the third conductor? | Is the second pin electrically connected to the fourth conductor? |
|---|---|---|
| First state | Yes | Yes |
| Second state | Yes | No |
| Third state | No | Yes |
| Fourth state | No | No |

Referring to FIGS. 2A to 2D, in this embodiment, each of the first pins 121*a*, 121*b*, 121*c*, 121*d* and each of the second pins 122*a*, 122*b*, 122*c*, 122*d* are conductive columns. The first conductor 111, the second conductor 112, the third conductor 113, and the fourth conductor 114 are four conductive contacts for being contacted by the conductive columns. As shown in FIG. 2A, the first pin 121*a* and the second pin 122*a* are two conductive columns of the same length. The first conductor 111, the second conductor 112, the third conductor 113, and the fourth conductor 114 are four conductive sleeves for being contacted by the conductive columns. The first pin 121*a* has a length which is long enough to contact the first conductor 111 and the third conductor 113, and the second pin 122*a* has a length which is long enough to contact the second conductor 112 and the fourth conductor 114. In the case of FIG. 2A, the plug 1*a* is in the first state. That is, in the first state, the first pin 121*a* contacts the first conductor 111 and the third conductor 113, and the second pin 122*a* contacts the second conductor 112 and the fourth conductor 114. As shown in FIG. 2B, the first pin 121*b* and the second pin 122*b* are two conductive columns of different lengths. The first conductor 111, the second conductor 112, the third conductor 113, and the fourth conductor 114 are four conductive sleeves for being contacted by the conductive columns. The first pin 121*b* has a length which is long enough to contact the first conductor 111 and the third conductor 113, and the second pin 122*b* has a length which is capable of contacting the second conductor 112 only. In the case of FIG. 2B, the plug 1*b* is in the second state. That is, in the second state, the first pin 121*b* contacts the first conductor 111 and the third conductor 113, and the second pin 122*b* contacts the second conductor 112 only. As shown in FIG. 2C, the first pin 121*c* and the second pin 122*c* are two conductive columns of different lengths. The first conductor 111, the second conductor 112, the third conductor 113, and the fourth conductor 114 are four conductive sleeves for being contacted by the conductive columns. The first pin 121*c* has a length which is capable of contacting the first conductor 111 only, and the second pin 122*c* has a length which is long enough to contact the second conductor 112 and the fourth conductor 114. In the case of FIG. 2C, the plug 1*c* is in the third state. That is, in the third state, the first pin 121*c* contacts the first conductor 111 only, and the second pin 122*c* contacts the second conductor 112 and the fourth conductor 114. As shown in FIG. 2D, the first pin 121*d* and the second pin 122*d* are two conductive columns of the same length. The first conductor 111, the second conductor 112, the third conductor 113, and the fourth conductor 114 are four conductive sleeves for being contacted by the conductive columns. The first pin 121*d* has a length which is capable of contacting the first conductor 111 only, and the second pin 122*d* has a length which is capable of contacting the second conductor 112 only. In the case of FIG. 2D, the plug 1*d* is in the fourth state. That is, in the fourth state, the first pin 121*d* contacts the first conductor 111 only, and the second pin 122*d* contacts the second conductor 112 only. Accordingly, the plug 1 can have four different states by changing different second members 12*a*, 12*b*, 12*c* and 12*d* which respectively comprise different first pins 121*a*, 121*b*, 121*c*, 121*d* and different second pins 122*a*, 122*b*, 122*c*, 122*d*. Alternatively, the plug 1 can also have four different states by adopting only one second member 12 but changing the first pins 121*a*, 121*c* of different lengths and changing second pins 122*a*, 122*b* of different lengths (e.g., one body of second member, two kinds of first pins, and two kinds of second pins). In addition, if the connected positions of the first pin 121*b* and the second pin 122*b* of the second member 12*b* of the plug 1*b*, which is in the second state, are switched, the plug 1*b* can be changed from the second state (FIG. 2B) to the third state (FIG. 2C). In more detailed, the second member is rotated 180 degrees on the long axis thereof, so that the first pin can be moved to the position of the second pin while the second pin can be moved to the position of the first pin. Accordingly, the plug can have four different states by preparing only three kinds of second members.

Referring to FIGS. 2A to 2D, in this embodiment, the first member 11 further comprises a first housing 115, and the first conductor 111, the second conductor 112, the third conductor 113, and the fourth conductor 114 are disposed inside the first housing 115. The first housing 115 is defined with a first direction D1 and a second direction D2 which is different from the first direction D1. The first conductor 111 and the third conductor 113 are arranged along the first direction D1, the second conductor 112 and the fourth conductor 114 are arranged along the first direction D1, and the first conductor 111 and the second conductor 112 are juxtaposed in the second direction D2. In particular, the first direction D1 and the second direction D2 can have an included angle, which is, for example but not limited to, 15 degrees, 30 degrees, 45 degrees, 60 degrees, or 90 degrees. Preferably, the included angle between the first direction D1 and the second direction D2 is 90 degrees, which means that the first direction D1 is perpendicular to the second direction D2.

In this embodiment, each of the second members 12*a*, 12*b*, 12*c* and 12*d* further comprises a second housing 125 which is structurally corresponding to the first housing 115.

The first pin 121*a*, 121*b*, 121*c* or 121*d* and the second pin 122*a*, 122*b*, 122*c* or 122*d* are disposed on one side of the second housing 125, and the third pin 123 and the fourth pin 124 are disposed on another side the second housing 125. The second housing 125 is defined with a third direction D3 and a fourth direction D4 which is different from the third direction D3. The first pin 121*a*, 121*b*, 121*c* or 121*d* and the second pin 122*a*, 122*b*, 122*c* or 122*d* extend outwardly from the second housing 125 along the third direction D3, and the first pin 121*a*, 121*b*, 121*c* or 121*d* and the second pin 122*a*, 122*b*, 122*c* or 122*d* are juxtaposed in the fourth direction D4. In particular, the third direction D3 and the fourth direction D4 can have an included angle, which is, for example but not limited to, 15 degrees, 30 degrees, 45 degrees, 60 degrees, or 90 degrees. Preferably, the included angle between the third direction D3 and the fourth direction D4 is 90 degrees, which means that the third direction D3 is perpendicular to the fourth direction D4.

Figure 3A:
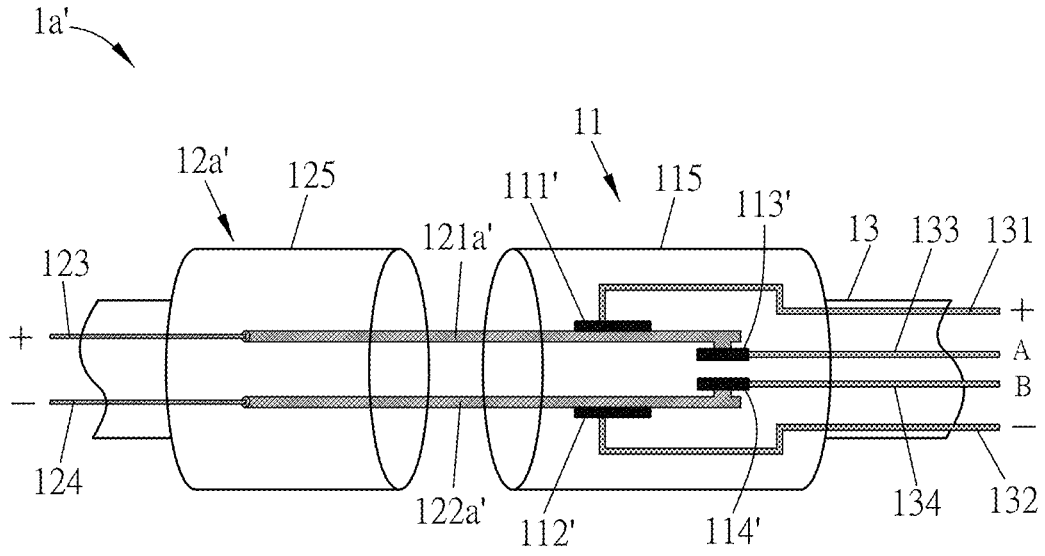
FIG. 3A is a schematic diagram showing the internal configuration of a plug according to a second embodiment of this disclosure, wherein the plug is in a first state.
Figure 3B:
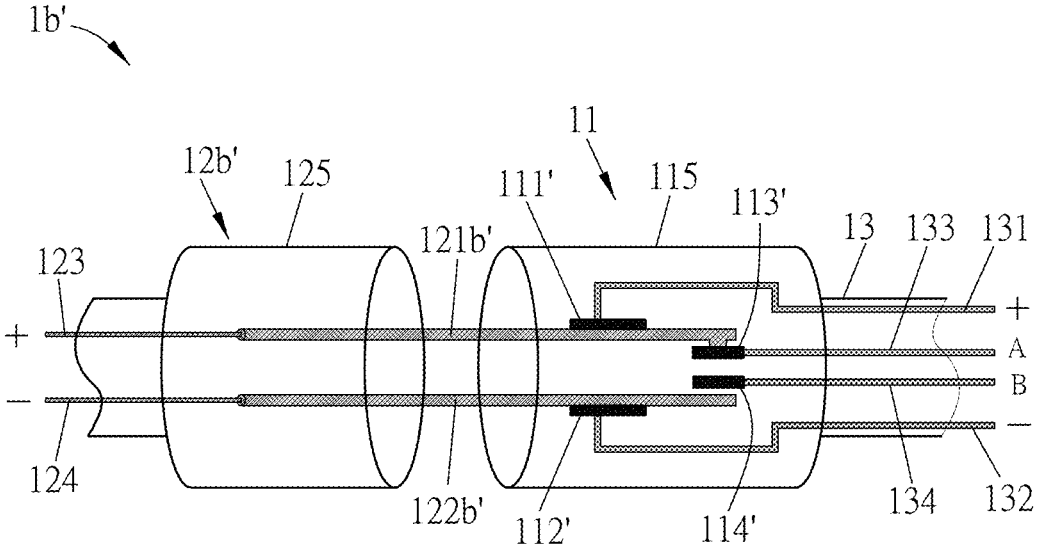
FIG. 3B is a schematic diagram showing the internal configuration of the plug according to the second embodiment of this disclosure, wherein the plug is in a second state.
Figure 3C:
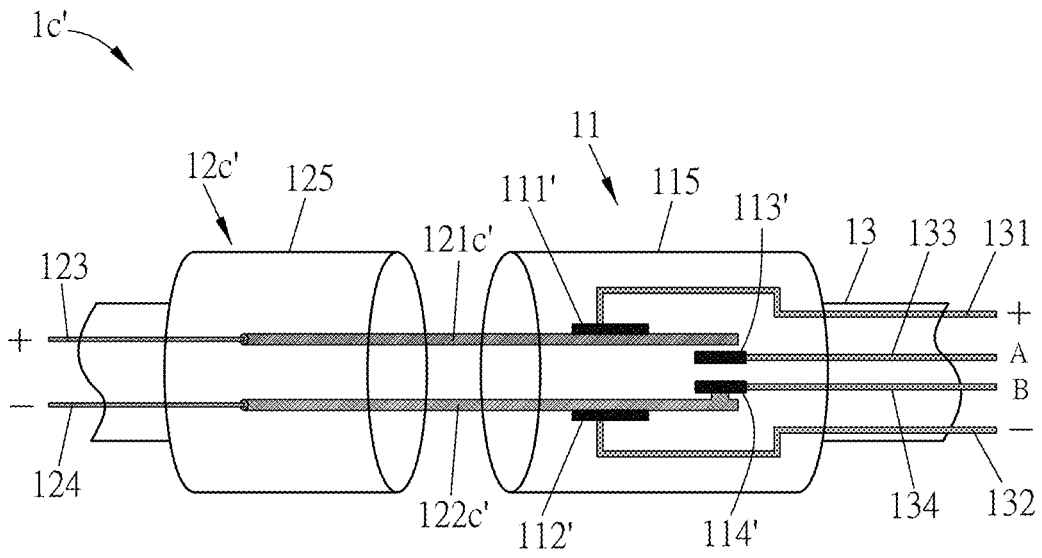
FIG. 3C is a schematic diagram showing the internal configuration of the plug according to the second embodiment of this disclosure, wherein the plug is in a third state.
Figure 3D:
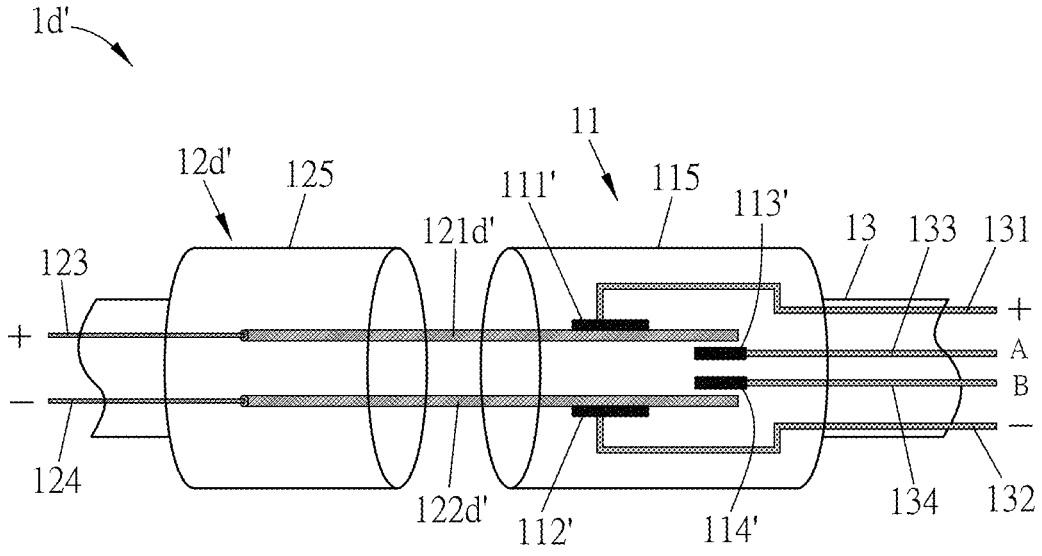
FIG. 3D is a schematic diagram showing the internal configuration of the plug according to the second embodiment of this disclosure, wherein the plug is in a fourth state.

FIG. 3A is a schematic diagram showing the internal configuration of a plug according to a second embodiment of this disclosure, wherein the plug is in a first state. FIG. 3B is a schematic diagram showing the internal configuration of the plug according to the second embodiment of this disclosure, wherein the plug is in a second state. FIG. 3C is a schematic diagram showing the internal configuration of the plug according to the second embodiment of this disclosure, wherein the plug is in a third state. FIG. 3D is a schematic diagram showing the internal configuration of the plug according to the second embodiment of this disclosure, wherein the plug is in a fourth state. Referring to FIGS. 3A to 3D, in this embodiment, each of the first pins 121*a*', 121*b*', 121*c*', 121*d*' and each of the second pins 122*a*', 122*b*', 122*c*', 122*d*' are conductive columns. The first conductor 111', the second conductor 112', the third conductor 113', and the fourth conductor 114' are four conductive contacts for being contacted by the conductive columns. As shown in FIG. 3A, the first pin 121*a*' and the second pin 122*a*' are two conductive columns of the same length, and each of them is configured with a bump. The first conductor 111', the second conductor 112', the third conductor 113', and the fourth conductor 114' are four conductive blocks for being contacted by the conductive columns. The first pin 121*a*' is long enough and configured with the bump specifically corresponding to the third conductor 113', so that it can contact both of the first conductor 111' and the third conductor 113'. The second pin 122*a*' is also long enough and configured with the bump specifically corresponding to the fourth conductor 114', so that it can contact both of the second conductor 112' and the fourth conductor 114'. In the case of FIG. 3A, the plug 1*a*' is in the first state. As shown in FIG. 3B, the first pin 121*b*' and the second pin 122*b*' are two conductive columns of the same length, and one of them is configured with a bump but another without. The first conductor 111', the second conductor 112', the third conductor 113', and the fourth conductor 114' are four conductive blocks for being contacted by the conductive columns. The first pin 121*b*' is long enough and configured with the bump specifically corresponding to the third conductor 113, so that it can contact both of the first conductor 111' and the third conductor 113'. The second pin 122*b*' is long enough but configured without any bump, so that it can only contact the second conductor 112'. In the case of FIG. 3B, the plug 1*b*' is in the second state. As shown in FIG. 3C, the first pin 121*c*' and the second pin 122*c*' are two conductive columns with the same length, and one of them is configured with a bump but another without. The first conductor 111', the second conductor 112', the third conductor 113', and the fourth conductor 114' are four conductive blocks for being contacted by the conductive columns. The first pin 121*c*' is long enough but configured without any bump, so that it can only contact the first conductor 111'. The second pin 122*c*' is long enough and configured with the bump specifically corresponding to the fourth conductor 114', so that it can contact both of the second conductor 112' and the fourth conductor 114'. In the case of FIG. 3C, the plug 1*c*' is in the third state. As shown in FIG. 3D, the first pin 121*d*' and the second pin 122*d*' are two conductive columns with the same length but both of them are configured without any bump. The first conductor 111', the second conductor 112', the third conductor 113', and the fourth conductor 114' are four conductive blocks for being contacted by the conductive columns. The first pin 121*d*' is long enough but configured without any bump, so that it can only contact the first conductor 111'. The second pin 122*d*' is long enough but also configured without any bump, so that it can only contact the second conductor 112'. In the case of FIG. 3D, the plug 1*d*' is in the fourth state. To be noted, the structures, the elements and the functions of the plug 1*a*', 1*b*', 1*c*', 1*d*' of the second embodiment are nearly the same as those of the plug 1*a*, 1*b*, 1*c*, 1*d* of the first embodiment. The differences between the second embodiment and the first embodiment are the shapes of the first conductor, the second conductor, the third conductor, and the fourth conductor, and the shapes and lengths of the first pin and second pin. The shapes and lengths of the conductors and pins can be varied according to the requirements of the end-user products. Any configuration which can provide four different states, such as by changing several second members, by changing a few first pins and a few second pins of the second member, and by connecting the second member with the first member in two different schemes, is considered to be applied. This disclosure is not limited thereto. In addition, each conductor or each pin can be entirely or partially (e.g., only the outer surfaces) made of metal, alloy, carbon, polymer conductive material, or any other material that conducts the current, and this disclosure is not limited.

In summary, the plug 1 has four different second members 12*a*, 12*b*, 12*c*, 12*d* (or 12*a*', 12*b*', 12*c*', 12*d*'), so that the plug 1 can be changed between four states by selecting one of four second members 12*a*, 12*b*, 12*c*, 12*d* (or 12*a*', 12*b*', 12*c*', 12*d*') which respectively have four different first pins 121*a*, 121*b*, 121*c*, 121*d* (or 121*a*', 121*b*', 121*c*', 121*d*') and four different second pins 122*a*, 122*b*, 122*c*, 122*d* (or 122*a*', 122*b*', 122*c*', 122*d*'). Alternatively, the plug 1 may have only one second member 12, yet the plug 1 can be changed between four states by selecting one of two first pins 121*a*, 121*c* (or 121*a*', 121*c*') and one of two second pins 122*a*, 122*b* (or 122*a*', 122*b*'). Furthermore, the plug 1 may have three different second members 12*a*, 12*b*, 12*d* (or 12*a*', 12*b*', 12*d*'), so that the plug 1 can be changed between four states by selecting one of three second members 12*a*, 12*b*, 12*d* (or 12*a*', 12*b*', 12*d*') which respectively have three different first pins 121*a*, 121*b*, 121*d* (or 121*a*', 121*b*', 121*d*') and three different second pins 122*a*, 122*b*, 122*d* (or 122*a*', 122*b*', 122*d*') with selectively changing the connection schemes of the second member 12*b* (or 12*b*') and the first member 11.

Referring to FIGS. 2A to 2D and FIGS. 3A to 3D, in the aforementioned embodiments, each of the plugs 1*a*, 1*b*, 1*c*, 1*d*, 1*a*', 1*b*', 1*c*', 1*d*' further comprises a cable 13 connecting to the first member 11. The cable 13 comprises a first conductive wire 131, a second conductive wire 132, a third conductive wire 133, and a fourth conductive wire 134. The first conductive wire 131 is electrically connected to the first conductor 111 (or 111') for power transmitting. For example, the first conductive wire 131 is electrically connected to a positive electrode of a power source (the sign "+" as shown in FIGS. 2A to 2D and FIGS. 3A to 3D). The second conductive wire 132 is electrically connected to the second conductor 112 (or 112') for power transmitting.

For example, the second conductive wire 132 is electrically connected to a negative electrode of a power source (the sign "−" as shown in FIGS. 2A to 2D and FIGS. 3A to 3D). The third conductive wire 133 is electrically connected to the third conductor 113 (or 113'), and the fourth conductive wire 134 is electrically connected to the fourth wire 114 (or 114'). Specifically, when the third conductor 113 (or 113') is electrically connected with the first conductor 111 (or 111'), the third conductive wire 133 can be used for transmitting an electrical signal A. When the fourth conductor 114 (or 114') is electrically connected with the second conductor 112 (or 112'), the fourth conductive wire 134 can be used for transmitting an electrical signal B. For example, as shown in FIGS. 2A and 3A, when the plug 1*a* (or 1*a'*) is in the first state, the first pin 121*a* (or 121*a'*) is electrically connected with the first conductor 111 (or 111') and the third conductor 113 (or 113'), and the second pin 122*a* (or 122*a'*) is electrically connected with the second conductor 112 (or 112') and the fourth conductor 114 (or 114'). Under this configuration, the third conductive wire 133 transmits the electrical signal A, and the fourth conductive wire 134 transmits the electrical signal B. As shown in FIGS. 2B and 3B, when the plug 1*b* (or 1*b'*) is in the second state, the first pin 121*b* (or 121*b'*) is electrically connected with the first conductor 111 (or 111') and the third conductor 113 (or 113'), and the second pin 122*b* (or 122*b'*) is electrically connected with the second conductor 112 (or 112') only. Under this configuration, only the third conductive wire 133 transmits the electrical signal A. As shown in FIGS. 2C and 3C, when the plug 1*c* (or 1*c'*) is in the third state, the first pin 121*c* (or 121*c'*) is electrically connected with the first conductor 111 (or 111') only, and the second pin 122*c* (or 122*c'*) is electrically connected with the second conductor 112 (or 112') and the fourth conductor 114 (or 114'). Under this configuration, only the fourth conductive wire 134 transmits the electrical signal B. As shown in FIGS. 2D and 3D, when the plug 1*d* (or 1*d'*) is in the fourth state, the first pin 121*d* (or 121*d'*) is electrically connected with the first conductor 111 (or 111') only, and the second pin 122*d* (or 122*d'*) is electrically connected with the second conductor 112 (or 112') only. Under this configuration, the third conductive wire 133 does not transmit the electrical signal A, and the fourth conductive wire 134 does not transmit the electrical signal B.

Figure 4:
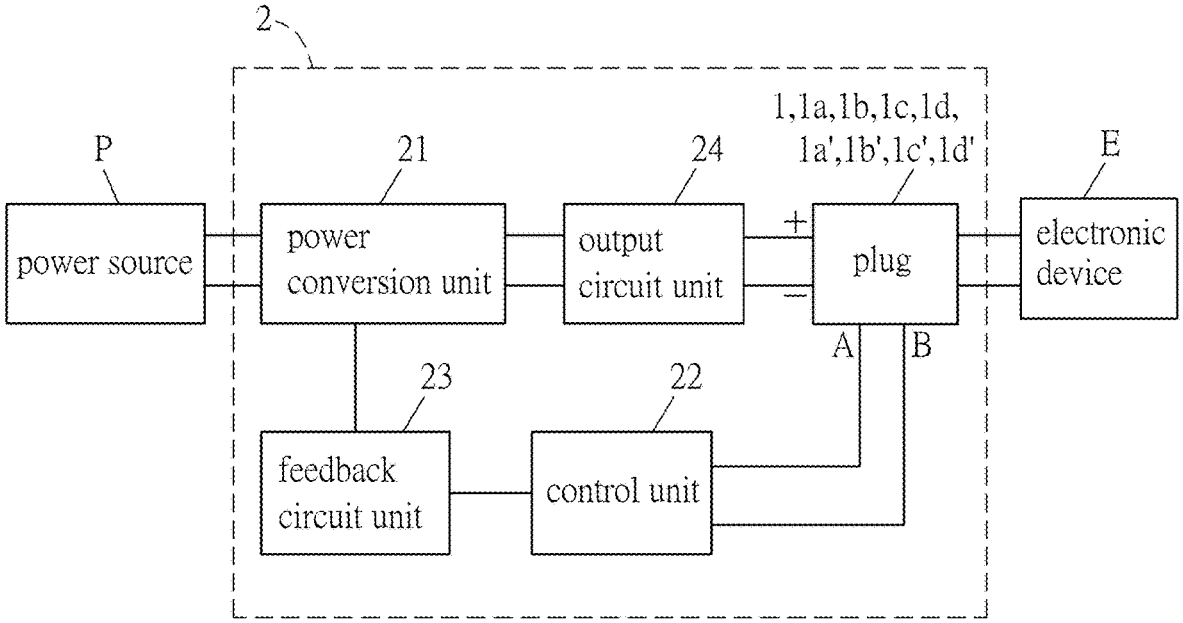
FIG. 4 is a schematic diagram showing a power source, an electronic device, and a power supply with a plug of this disclosure.

FIG. 4 is a schematic diagram showing a power source, an electronic device, and a power supply with a plug of this disclosure. As shown in FIG. 4, in this embodiment, the power supply 2 is disposed between a power source P and an electronic device E. The power supply 2 comprises a power conversion unit 21, a control unit 22, and a plug 1/1*a*/1*b*/1*c*/1*d*/1*a'*/1*b'*/1*c'*/1*d'*. The power conversion unit 21 is configured for receiving and converting an electric power provided from the power source P. The control unit 22 is electrically connected to the power conversion unit 21. The plug 1/1*a*/1*b*/1*c*/1*d*/1*a'*/1*b'*/1*c'*/1*d'* is electrically connected to the power conversion unit 21, the control unit 22, and the electronic device E. To be noted, the power source P can be, for example but not limited to, a household electricity, a wall socket, a battery, or any electric power source that is known to those skilled in the art. The electronic device E can be, for example but not limited to, a desktop computer, a laptop computer, a tablet computer, a mobile phone, a GPS navigation device, a PDA device, an energy storage device, or any of other information devices or home appliances. Furthermore, the structures, the elements, and the functions of the plugs 1, 1*a*, 1*b*, 1*c*, 1*d*, 1*a'*, 1*b'*, 1*c'*, 1*d'* have been described above, and the detailed description thereof will not be repeated. In addition, although the figure of this embodiment take the plugs 1, 1*a*, 1*b*, 1*c*, 1*d*, 1*a'*, 1*b'*, 1*c'*, 1*d'* as examples, yet any of the plugs mentioned in the above paragraphs and able to provide four different states can be applied in this embodiment. This disclosure is not limited thereto.

Referring to FIG. 4 and the following Table II, the control unit 22 controls the power conversion unit 21 according to the state of the plug 1/1*a*/1*b*/1*c*/1*d*/1*a'*/1*b'*/1*c'*/1*d'*. If the plug 1/1*a*/1*a'* is in the first state, the power conversion unit 21 provides a first voltage V1 to the electronic device E through the plug 1/1*a*/1*a'*. If the plug 1/1*b*/1*b'* is in the second state, the power conversion unit 21 provides a second voltage V2 to the electronic device E through the plug 1/1*b*/1*b'*. If the plug 1/1*c*/1*c'* is in the third state, the power conversion unit 21 provides a third voltage V3 to the electronic device E through the plug 1/1*c*/1*c'*. If the plug 1/1*d*/1*d'* is in the fourth state, the power conversion unit 21 provides a fourth voltage V4 to the electronic device E through the plug 1/1*d*/1*d'*. As mentioned above, when the plug 1/1*a*/1*a'* is in the first state, it transmits the electrical signal A and the electrical signal B to the control unit 22. When the plug 1/1*b*/1*b'* is in the second state, it transmits only the electrical signal A to the control unit 22. When the plug 1/1*c*/1*c'* is in the third state, it transmits only the electrical signal B to the control unit 22. When the plug 1/1*d*/1*d'* is in the fourth state, it does not transmit any of the electrical signal A and the electrical signal B to the control unit 22. The control unit 22 controls the power conversion unit 21 to output one of the four different voltages to the plug 1/1*a*/1*b*/1*c*/1*d*/1*a'*/1*b'*/1*c'*/1*d'* based on whether the control unit 22 receives the electrical signal A and/or the electrical signal B from the plug 1/1*a*/1*b*/1*c*/1*d*/1*a'*/1*b'*/1*c'*/1*d'*. Afterward, the plug 1/1*a*/1*b*/1*c*/1*d*/1*a'*/1*b'*/1*c'*/1*d'* provides one of the four different voltages to the electronic device E. To be noted, in other modified embodiments, it is possible to design more separated conductors inside the first member 11, so that the power supply 2 can be manually adjusted through the plug 1 to provide more than four different voltages. For example, if the first member 11 of the plug 1 comprises six conductors (e.g., adding a fifth conductor and a sixth conductor to the aforementioned embodiment), the power supply 2 can provide up to nine different voltages, according to the differently configured sets of the pins of the second member(s) 12 in cooperation with the control unit 22.

TABLE II

States of plug, electrical condition and signals of each state, and outputted voltages of power conversion unit.

| State of plug | Is the first pin electrically connected to the third conductor? | Is the second pin electrically connected to the fourth conductor? | Electrical signal | Outputted voltage |
|---|---|---|---|---|
| First state | Yes | Yes | both A and B | V1 |
| Second state | Yes | No | only A | V2 |
| Third state | No | Yes | only B | V3 |
| Fourth state | No | No | none | V4 |

In this embodiment, the power supply 2 further comprises a feedback circuit unit 23 electrically connected between the control unit 22 and the power conversion unit 21. The feedback circuit unit 23 adjusts the operation of the power conversion unit 21 according to the signal outputted from the control unit 22. Specifically, the control unit 22 adjusts the signal outputted to the feedback circuit unit 23 according to the schemes of the electrical signals A and B transmitted from the plug 1/1*a*/1*b*/1*c*/1*d*/1*a*'/1*b*'/1*c*'/1*d*', and then the feedback circuit unit 23 adjusts the operation of the power conversion unit 21 according to the signal outputted from the control unit 22.

In this embodiment, the power supply 2 further comprises an output circuit unit 24 electrically connected between the power conversion unit 21 and the plug 1/1*a*/1*b*/1*c*/1*d*/1*a*'/1*b*'/1*c*'/1*d*'. The output circuit unit 24 is configured to stabilize the voltages and the currents outputted from the power conversion unit 21.

Figure 5A:
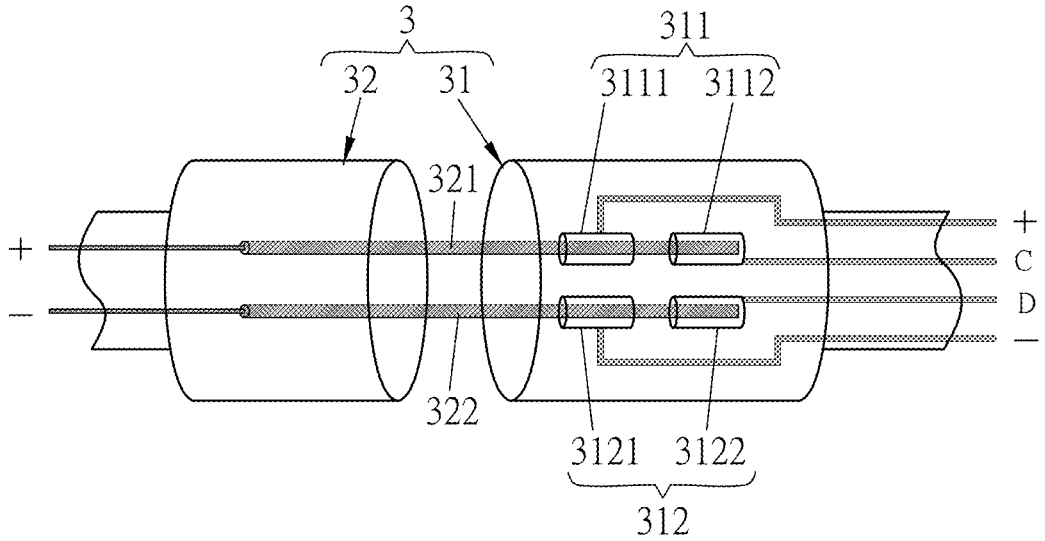
FIG. 5A is a schematic diagram showing the internal configuration of a power connector according to an embodiment of this disclosure, wherein the power connector is in a first connecting mode.
Figure 5B:
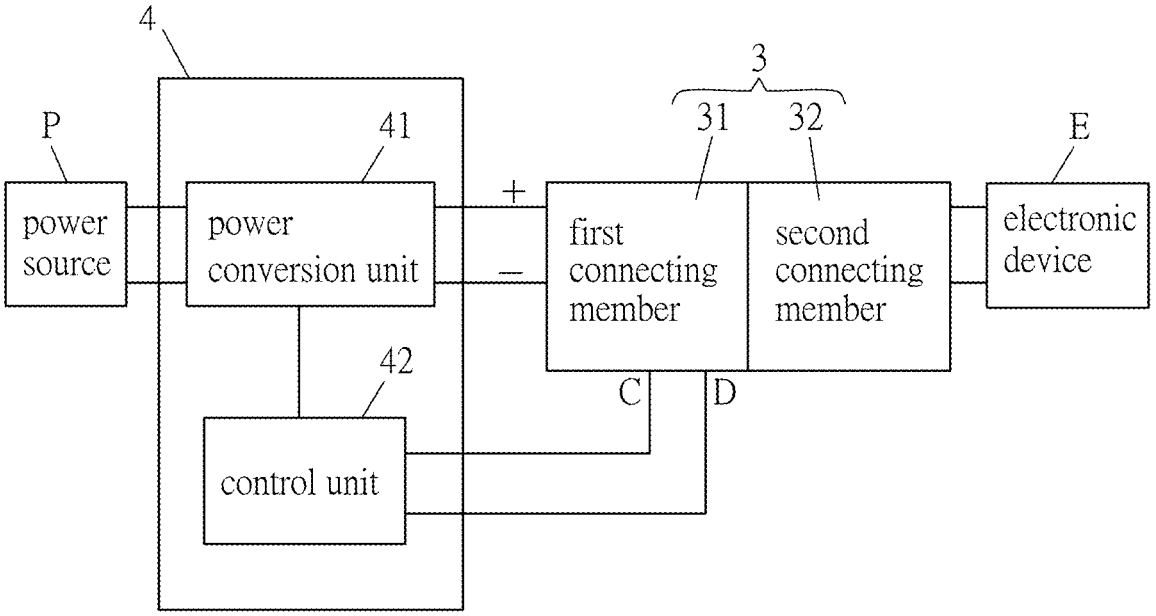
FIG. 5B is a schematic diagram showing a power source, an electronic device, and a power adapter with a power connector of this disclosure.

FIG. 5A is a schematic diagram showing the internal configuration of a power connector according to an embodiment of this disclosure, wherein the power connector is in a first connecting mode, and FIG. 5B is a schematic diagram showing a power source, an electronic device, and the power adapter with a power connector of this disclosure. Referring to FIGS. 5A and 5B, in this embodiment, the power connector 3 comprises a first connecting member 31 and a second connecting member 32, which are detachably connected with each other. The first connecting member 31 is electrically connected to a power adapter 4, and the second connecting member 32 is electrically connected to an electronic device E. The first connecting member 31 comprises a first conductive set 311 and a second conductive set 312. The first conductive set 311 comprises a first conductor 3111 and a third conductor 3112, and the second conductive set 312 comprises a second conductor 3121 and a fourth conductor 3122. The second connecting member 32 comprises a first terminal 321 and a second terminal 322. Specifically, the structure, the elements and the functions of the power connector 3 of this embodiment are nearly the same as those of the plug 1/1*a*/1*b*/1*c*/1*d*/1*a*'/1*b*'/1*c*'/1*d*' of the first and the second embodiments. That is, the first conductor 3111, the second conductor 3121, the third conductor 3112, and the fourth conductor 3122 of the power connector 3 can be referred to the first conductor 111, 111', the second conductor 112, 112', the third conductor 113, 113', and the fourth conductor 114, 114' of the plugs 1, 1*a*, 1*b*, 1*c*, 1*d*, 1*a*', 1*b*', 1*c*', 1*d*'. In addition, the first terminal 321 and the second terminal 322 of the power connector 3 can be referred to the first pin 121*a*, 121*b*, 121*c*, 121*d*, 121*a*', 121*b*', 121*c*', 121*d*' and the second pin 122*a*, 122*b*, 122*c*, 122*d*, 122*a*', 122*b*', 122*c*', 122*d*'. The structures, the elements and the functions thereof have been described in the above paragraphs, so the detailed descriptions are not repeated.

In this embodiment, when the first connecting member 31 is connected to the second connecting member 32, the power connector 3 is in a first connecting mode, a second connecting mode, a third connecting mode or a fourth connecting mode. For example, when the power connector 3 is in the first connecting mode, the first terminal 321 is connected to the first conductor 3111 and the third conductor 3112, and the second terminal 322 is connected to the second conductor 3121 and the fourth conductor 3122. When the power connector 3 is in the second connecting mode, the first terminal 321 is connected to the first conductor 3111 and the third conductor 3112, and the second terminal 322 is connected to the second conductor 3121 only. When the power connector 3 is in the third connecting mode, the first terminal 321 is connected to the first conductor 3111 only, and the second terminal 322 is connected to the second conductor 3121 and the fourth conductor 3122. When the power connector 3 is in the fourth connecting mode, the first terminal 321 is connected to the first conductor 3111 only, and the second terminal 322 is connected to the second conductor 3121 only. Similarly, the power connector 3 has four different second connecting members 32, so that the power connector 3 can have four different connecting modes by changing the different second connecting members 32 respectively with different first terminals 321 and different second terminals 322. Alternatively, the power connector 3 may comprise only one second connecting member 32, and then the power connector 3 may have four different connecting modes by changing two different first terminals 321 and the two different second terminals 322 of the second connecting member 32.

In this embodiment, the first conductor 3111 and the second conductor 3121 are individually electrically connected to a power conversion unit 41 of the power adapter 4, and the third conductor 3112 and the fourth conductor 3122 are individually electrically connected to a control unit 42 of the power adapter 4. For example, the first conductor 3111 and the second conductor 3121 are respectively electrically connected to a positive electrode and a negative electrode of the power conversion unit 41 of the power adapter 4. The positive electrode and the negative electrode of the power conversion unit 41 are presented as the signs "+" and "−" as shown in FIGS. 5A and 5B. When the power connector 3 is in the first connecting mode, the first terminal 321 is connected with the first conductor 3111 and the third conductor 3112, and the second terminal 322 is connected with the second conductor 3121 and the fourth conductor 3122, in which the third conductor 3112 transmits an electrical signal C, and the fourth conductor 3122 transmits an electrical signal D. When the power connector 3 is in the second connecting mode, the first terminal 321 is connected with the first conductor 3111 and the third conductor 3112, and the second terminal 322 is connected with the second conductor 3121, in which only the third conductor 3112 transmits the electrical signal C. When the power connector 3 is in the third connecting mode, the first terminal 321 is connected with the first conductor 3111, and the second terminal 322 is connected with the second conductor 3121 and the fourth conductor 3122, in which only the fourth conductor 3122 transmits the electrical signal D. When the power connector 3 is in the fourth connecting mode, the first terminal 321 is connected with the first conductor 3111, and the second terminal 322 is connected with the second conductor 3121, in which the third conductor 3112 does not transmit the electrical signal C and the fourth conductor 3122 does not transmit the electrical signal D as well.

Referring to FIG. 5B and the following Table III, in this embodiment, when the power connector 3 is in the first connecting mode, the power adapter 4 transmits a first voltage V1 to the electronic device E. When the power connector 3 is in the second connecting mode, the power adapter 4 transmits a second voltage V2 to the electronic device E. When the power connector 3 is in the third connecting mode, the power adapter 4 transmits a third voltage V3 to the electronic device E. When the power connector 3 is in the fourth connecting mode, the power adapter 4 transmits a fourth voltage V4 to the electronic device E. As mentioned above, when the power connector 3 is in the first state, it transmits the electrical signal C and the electrical signal D to the control unit 42. When the power connector 3 is in the second state, it transmits only the electrical signal C to the control unit 42. When the power connector 3 is in the third state, it transmits only the electrical signal D to the control unit 42. When the power connector 3 is in the fourth state, it does not transmit any of the electrical signal C and the electrical signal D to the control unit 42. The power adapter 4 outputs one of the four different voltages to the power connector 3 based on whether the control unit 42 receives the electrical signal C and/or the electrical signal D from the power connector 3. Afterward, the power connector 3 provides one of the four different voltages to the electronic device E.

TABLE III

Connecting modes of power connector, electrical condition and signals of each state, and transmitted voltages of power adapter.

| Connecting mode of power connector | Is the first terminal electrically connected to the third conductor? | Is the second terminal electrically connected to the fourth conductor? | Electrical signal | Transmitted voltage |
|---|---|---|---|---|
| First connecting mode | Yes | Yes | both C and D | V1 |
| Second connecting mode | Yes | No | only C | V2 |
| Third connecting mode | No | Yes | only D | V3 |
| Fourth connecting mode | No | No | none | V4 |

In summary, this disclosure can change the output voltage of the plug, the power supply and the power connector by changing the state of the plug and the connecting mode of the power connector, so that the complicated circuits or circuit traces conventionally designed for the plug, the power supply and the power connector are not needed, thereby decreasing the manufacturing cost and increasing the reliability of the plug, the power supply and the power connector. Besides, the application flexibility of the plug, the power supply and the power connector can be effectively enhanced.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. A plug comprising:

a first member comprising:

a first conductor for power receiving, a second conductor for power receiving, a third conductor selectively electrically connected to the first conductor, and a fourth conductor selectively electrically connected to the second conductor, wherein the first conductor, the second conductor, the third conductor and the fourth conductor are separated from each other; and a second member detachably connected to the first member and comprising:

a first pin electrically connected to the first conductor and selectively electrically connected to the third conductor, a second pin electrically connected to the second conductor and selectively electrically connected to the fourth conductor, a third pin electrically connected to the first pin for power outputting, and a fourth pin electrically connected to the second pin for power outputting, wherein the first pin and the second pin are separated from each other, and the third pin and the fourth pin are separated from each other;

wherein when the second member is connected to the first member, the plug is in a first state, a second state, a third state or a fourth state;

in the first state, the first pin is electrically connected to the first conductor and the third conductor, and the second pin is electrically connected to the second conductor and the fourth conductor;

in the second state, the first pin is electrically connected to the first conductor and the third conductor, and the second pin is only electrically connected to the second conductor;

in the third state, the first pin is only electrically connected to the first conductor, and the second pin is electrically connected to the second conductor and the fourth conductor; and in the fourth state, the first pin is only electrically connected to the first conductor, and the second pin is only electrically connected to the second conductor.

2. The plug of claim 1, further comprising a cable connecting to the first member, wherein the cable comprises a first conductive wire, a second conductive wire, a third conductive wire and a fourth conductive wire, the first conductive wire is electrically connected to the first conductor for power transmitting, the second conductive wire is electrically connected to the second conductor for power transmitting, the third conductive wire is electrically connected to the third conductor, and the fourth conductive wire is electrically connected to the fourth wire.

3. The plug of claim 1, wherein the first member further comprises a first housing, the first conductor, the second conductor, the third conductor and the fourth conductor are disposed inside the first housing, the first housing is defined with a first direction and a second direction different from the first direction, the first conductor and the third conductor are arranged along the first direction, the second conductor and the fourth conductor are arranged along the first direction, and the first conductor and the second conductor are juxtaposed in the second direction.

4. The plug of claim 3, wherein the second member further comprises a second housing corresponding to the first housing, the first pin and the second pin are disposed on one side of the second housing, the third pin and the fourth pin are disposed on another side the second housing, the second housing is defined with a third direction and a fourth direction different from the third direction, the first pin and the second pin extend outwardly from the second housing along the third direction, and the first pin and the second pin are juxtaposed in the fourth direction.

5. The plug of claim 4, wherein the first pin and the second pin are two conductive columns, the first conductor, the second conductor, the third conductor and the fourth conductor are four conductive contacts for being contacted by the conductive columns;

in the first state, the first pin contacts the first conductor and the third conductor, and the second pin contacts the second conductor and the fourth conductor;

in the second state, the first pin contacts the first conductor and the third conductor, and the second pin only contacts the second conductor;

in the third state, the first pin only contacts the first conductor, and the second pin contacts the second conductor and the fourth conductor; and in the fourth state, the first pin only contacts the first conductor, and the second pin only contacts the second conductor.

6. A power supply disposed between a power source and an electronic device, comprising:

a power conversion unit for receiving and converting an electric power provided from the power source;

a control unit electrically connected to the power conversion unit; and a plug electrically connected to the power conversion unit, the control unit and the electronic device, wherein the plug comprises:

a first member comprising a first conductor, a second conductor, a third conductor and a fourth conductor, wherein the first conductor and the second conductor are electrically connected to the power conversion unit, and the third conductor and the fourth conductor are electrically connected to the control unit, and a second member detachably connected to the first member and comprising a first pin, a second pin, a third pin and a fourth pin, wherein the first pin is electrically connected to the first conductor and selectively electrically connected to the third conductor, the second pin is electrically connected to the second conductor and selectively electrically connected to the fourth conductor, the third pin is electrically connected to the first pin and the electronic device, and the fourth pin is electrically connected to the second pin and the electronic device;

wherein when the second member is connected to the first member, the plug is in a first state, a second state, a third state or a fourth state;

in the first state, the first pin is electrically connected to the first conductor and the third conductor, and the second pin is electrically connected to the second conductor and the fourth conductor;

in the second state, the first pin is electrically connected to the first conductor and the third conductor, and the second pin is only electrically connected to the second conductor;

in the third state, the first pin is only electrically connected to the first conductor, and the second pin is electrically connected to the second conductor and the fourth conductor; and in the fourth state, the first pin is only electrically connected to the first conductor, and the second pin is only electrically connected to the second conductor.

7. The power supply of claim 6, further comprising a feedback circuit unit electrically connected between the control unit and the power conversion unit, wherein the feedback circuit unit adjusts an operation of the power conversion unit according to a signal outputted from the control unit.

8. The power supply of claim 6, further comprising an output circuit unit electrically connected between the power conversion unit and the plug, wherein the output circuit unit is configured to stabilize a voltage and a current outputted from the power conversion unit.

9. The power supply of claim 6, wherein the control unit controls the power conversion unit according to a state of the plug; if the plug is in the first state, the power conversion unit provides a first voltage to the electronic device through the plug; if the plug is in the second state, the power conversion unit provides a second voltage to the electronic device through the plug; if the plug is in the third state, the power conversion unit provides a third voltage to the electronic device through the plug; and if the plug is in the fourth state, the power conversion unit provides a fourth voltage to the electronic device through the plug.

10. The power supply of claim 9, wherein the first member further comprises a first housing, the second member further comprises a second housing corresponding to the first housing, the first conductor, the second conductor, the third conductor and the fourth conductor are disposed inside the first housing, the first pin and the second pin are disposed on one side of the second housing, the third pin and the fourth pin are disposed on another side the second housing, the first housing is defined with a first direction and a second direction different from the first direction, the second housing is defined with a third direction and a fourth direction different from the third direction, the first conductor and the third conductor are arranged along the first direction, the second conductor and the fourth conductor are arranged along the first direction, the first conductor and the second conductor are juxtaposed in the second direction, the first pin and the second pin extend outwardly from the second housing along the third direction, and the first pin and the second pin are juxtaposed in the fourth direction.

11. The power supply of claim 10, wherein the first pin and the second pin are two conductive columns, the first conductor, the second conductor, the third conductor and the fourth conductor are four conductive contacts for being contacted by the conductive columns;

in the first state, the first pin contacts the first conductor and the third conductor, and the second pin contacts the second conductor and the fourth conductor;

in the second state, the first pin contacts the first conductor and the third conductor, and the second pin only contacts the second conductor;

in the third state, the first pin only contacts the first conductor, and the second pin contacts the second conductor and the fourth conductor; and in the fourth state, the first pin only contacts the first conductor, and the second pin only contacts the second conductor.

* * * * *